US012523119B2

(12) United States Patent
Talapatra et al.

(10) Patent No.: US 12,523,119 B2
(45) Date of Patent: Jan. 13, 2026

(54) DOWNHOLE HEATING TOOLS WITH INCREASED HEATING CAPACITY AND ASSOCIATED TOOLS AND METHODS

(71) Applicant: BISN Tec Ltd., Warrington (GB)

(72) Inventors: Didhiti Talapatra, Houston, TX (US); Billy Clark, Katy, TX (US); Bryon Mullen, Spring, TX (US); Paul Carragher, Houston, TX (US); Bobby Chancellor, Houston, TX (US)

(73) Assignee: BISN Tes Ltd., Warrington (GB)

( * ) Notice: Subject to any disclaimer, the term of this patent is extended or adjusted under 35 U.S.C. 154(b) by 0 days.

(21) Appl. No.: 18/112,386

(22) Filed: Feb. 21, 2023

(65) Prior Publication Data

US 2023/0265741 A1 Aug. 24, 2023

Related U.S. Application Data

(60) Provisional application No. 63/312,611, filed on Feb. 22, 2022.

(51) Int. Cl.

| | |
|---|---|
| ***E21B 36/00*** | (2006.01) |
| ***C22C 28/00*** | (2006.01) |
| ***E21B 33/138*** | (2006.01) |

(52) U.S. Cl.

CPC ..... *E21B 36/008* (2013.01); *C22C 28/00* (2013.01); *E21B 33/138* (2013.01); *E21B 36/00* (2013.01)

(58) Field of Classification Search

CPC ..... E21B 36/008; E21B 36/04

See application file for complete search history.

(56) References Cited

U.S. PATENT DOCUMENTS

| | | | | |
|---|---|---|---|---|
| 2,472,445 | A * | 6/1949 | Katharine | E21B 36/04 166/50 |
| 2,525,376 | A * | 10/1950 | Schmer | E21B 36/04 166/60 |
| 10,329,872 | B2 | 6/2019 | Carragher et al. | |
| 11,085,265 | B2 | 8/2021 | Rivas | |
| 11,401,776 | B2 | 8/2022 | Carragher et al. | |
| 11,428,067 | B2 | 8/2022 | Carragher | |
| 11,492,870 | B2 | 11/2022 | Carragher | |
| 11,525,326 | B2 | 12/2022 | Carragher | |
| 11,536,111 | B2 | 12/2022 | Carragher et al. | |

(Continued)

FOREIGN PATENT DOCUMENTS

| | | |
|---|---|---|
| WO | WO2018033760 | 2/2018 |

*Primary Examiner* — Blake Michener

(57) ABSTRACT

The present invention provides a downhole heating tool with an increased heating capacity for use in setting alloy plugs/seal in downhole target regions of wellbores, such as oil/gas wells. The increased heating capacity enables greater quantities of alloy to be melted in one operation. It also enables alloys with higher melting points to be melted in the downhole environment. To this end the heating tool comprises a plurality of discrete tubular heating units linked together by connection means that permit the movement of the tubular heating units relative to one another. The relative freedom of movement between the heating units facilitates a transition between a deployment configuration, in which the heating tool is optimised for deployment downhole, and a heating configuration, in which the heating tool adopts an expanded heating footprint within a downhole target region.

12 Claims, 11 Drawing Sheets

(56) References Cited

U.S. PATENT DOCUMENTS

| | | | | |
|---|---|---|---|---|
| 11,867,020 | B2 | 1/2024 | Carragher | |
| 2013/0118746 | A1 | 5/2013 | Delp | |
| 2019/0085659 | A1* | 3/2019 | Carragher | E21B 33/124 |
| 2019/0144355 | A1 | 5/2019 | Carragher | |
| 2020/0332620 | A1* | 10/2020 | Carragher | E21B 33/13 |
| 2022/0275700 | A1 | 9/2022 | Carragher et al. | |

* cited by examiner

DOWNHOLE HEATING TOOLS WITH INCREASED HEATING CAPACITY AND ASSOCIATED TOOLS AND METHODS

CROSS-REFERENCE TO RELATED APPLICATION

This application claims benefit to U.S. Provisional Patent Application No. 63/312,611, filed Feb. 22, 2022.

FIELD OF THE INVENTION

The present invention relates to using chemical heaters to melt metal which will solidify and form a downhole plug or seal in well environments such as oil and gas wells.

BACKGROUND OF THE INVENTION

It has been proven that eutectic alloys or bismuth based alloys are quite effective at forming plugs and seals in oil and gas wells by being run in the well as small diameter beads or cast on the outer diameter (OD) of a tube, melted at the target depth, and allowed to cool to a solid state.

These alloy plugs can be set in a variety of different downhole locations, such as inside the casing, inside the tubing or inside the open hole. Setting inside the open bore hole is often referred to as a "rock to rock" seal and is commonly used to plug and abandon the well after the tubing and casing have been removed. Seals can be melted and solidified in the annular spaces between the tubing and the casing, between the casing strings, or between the casing and the bore hole.

The applicants have developed a number of downhole heating tools for use in heating downhole target regions, examples of which have been published in International PCT Application Nos. WO 2011/151271 A1, WO 2014/096857 A2, WO 2014/096858 A2, WO 2017/191471 A1, WO 2017/203247 A1, WO 2017/203248 A1, and WO 2018/215786 A1.

In addition, the applicants have developed a number of downhole eutectic and/or bismuth alloy based plugging and/or sealing tools, examples of which have been also published in International PCT Application Nos. WO 2011/151271 A1, WO 2014/096857 A2, WO 2014/096858 A2, WO 2016/024122 A2, WO 2016/024123 A1, WO 2017/191471 A1, WO 2017/203247 A1, WO 2017/203248 A1, WO 2018/033760 A1, WO 2018/185482 A1, WO 2018/215786 A1, and WO 2019/097252 A2.

SUMMARY OF THE INVENTION

The heating tools of the present invention describe a way to make permanent or temporary, very large diameter alloy plugs or seals with multiple, relatively small diameter heaters in a well bore used for hydrocarbon production, water production, or fluid injection.

Alloy well plugs can vary in length depending on the temperature, pressure, and axial load requirements. The heating tools of the present invention, which preferably employ chemical heat sources that comprises thermite or a thermite blend, solve the problem of getting enough heat energy delivered to a large volume of alloy located at the target depth in a well with very large diameter casing. The energy requirement to melt a eutectic or bismuth alloy in a shallow, low temperature well bore can be quite high if the diameter is large, and the plug length is long.

Large casing sizes are used at the top of well bore geometries to isolate shallow aquifers, stabilize the bore hole, and provide a bushing commonly referred to as a drilling liner. There can be extra intermediate casing strings in the event of drilling difficulties or the need to cement the well in stages. The last casing string in the well is usually the production liner after which the production tubing and completion equipment are landed. After this construction phase the well will be used for production or injection. Later in the life of the well, there might be a need to plug the well either temporarily or permanently in one of many different locations or geometries.

Against this backdrop the present invention provides a downhole heating tool comprising a plurality of discrete tubular heating units linked together by connection means that permit the movement of the tubular heating units relative to one another; wherein the connection means facilitate a transition of the heating tool between a deployment configuration, in which the tubular heating units are arranged proximal to a central axis of the heating tool to optimise the geometry of the heating tool during its deployment downhole, and a heating configuration, in which at least one of the tubular heating units is displaced from the central axis to enable the heating tool to provide an expanded heating footprint within a downhole target region.

The downhole heating tool of the present invention makes it possible to plug or seal previously difficult or impossible sizes, geometries, and sealing alloy volumes.

In older systems the amount heat energy that could be delivered to a downhole target region was limited to one heater which, in deployments requiring the heater to run through small, restricted diameters, might have a small outside diameter (OD). The heater's heat output is restricted by length, diameter, effective heat transfer in the different well fluids, shipping, handling, manufacturing processes, heater wall materials, pressure holding capabilities, heat generating chemical volumes and other factors.

As will be appreciated from the embodiments described herein, the provision of a plurality of heating units adds more variables to the system which can be optimized to produce workable solutions for well geometries that were previously not possible to plug or seal because of the large gap between the heater outer diameter (OD) and diameter of the plug/seal that is to be placed in the downhole target region.

Rather than increasing the heating capacity of the downhole heating tool by simply making increasing the volume afforded to the heat source and making the tool bigger, the inventors have found that multiple small diameter heaters can be run through tubing restrictions and then used in concert to achieve the required heating effect in the downhole target region.

The following variables can be optimized: heater diameter, effective heater length, pressure containing requirements, and the quantity of heaters that can be run in the well. These variables that can now be used to optimize the heat energy supplied at the well's target depth: the number of starters and heaters; the methods to start the chemical reactions in each heater/starter (pressure, time delay, direct, wired communication, radio communication or any other method); the communication methods for the starters and the volume for data acquisition; the shape and diameter of each heater; the OD to ID ratio, the pressure rating, the cross-sectional area and volume for heater chemicals, heater wall material, and low melting temperature alloy material selection.

The multi-heating unit arrangement of the downhole heating tool of the present invention delivers an increased heating capacity downhole without increasing the profile of the downhole heating tool during its deployment to downhole target regions that may have restricted access.

It is envisaged that, not only does the increased heating capacity of the downhole heating tool allow for melting the increased quantities of alloy needed created plugs/seals with larger diameters, but the increased heat energy output can be used to melt alloys with higher melting points. One example being the Germanium/Bismuth alloys disclosed by the applicant in International PCT Application No. WO 2014/096857 A2.

As a consequence, it will be appreciated that even lower temperature well targets with high melting temperature alloys can now be plugged and sealed.

It is also envisaged that the increase heat output of the heating tools of the present invention means that is can be used to deploy alloy plugs/seals in downhole target regions with a wider range of well fluids, which in the past may have dampened the heat given off by a downhole heating tool.

Preferably adjacent tubular heating units may be linked together by the connection means, which comprise one or more flexible lines. In this way the individual heating units are able to move relative to one another whilst still retaining them as part of the overall heating tool.

It will be appreciated that downhole heating tool having a series of heating units linked in series by flexible lines will adopt an elongate chain-like arrangement when it is in the deployment configuration.

Preferably each of said flexible lines may be selected from a group consisting of: high temperature synthetic rope; thin metal tube; chain, such as link chain or drive type chain; wire rope, including multi cross-section wire rope with electrical conductor(s); a sheath made of a plastic like material (e.g., an elastomeric or non-elastomeric material); or combinations thereof.

Further preferably at least one of the flexible lines may be longer than the tubular heating units that they link together. In this way the adjacent heating units can arrange themselves side by side within the downhole target region to achieve their displacement from the central axis and in so doing expand heating footprint of the heating tool within the downhole target region.

Preferably at least one of the heating units is slimmer and longer than conventional downhole tubular heaters so that said heating units. In this regard, heating units of between 20 and 200 feet long are considered to constitute long. Further preferably, therefore, at least one of said slimmer and longer heating units may be between 20 and 200 feet long.

Preferably at least one of the heating units may comprise one or more bladed projections extending from a downhole end thereof. It is envisaged that providing bladed projections on the leading end of the heating unit (i.e., the end of the unit that extends furthest downhole hole) enables the heating unit to be used to agitate alloy in the downhole target region during the melting operation. Agitating the alloy during heating is consider beneficial because it not only helps with the transmission of heat through the alloy, but it also reduces the amount of foreign material (i.e., non-alloy) that is trapped in the alloy plug or seal.

Further preferably the heating units may comprise actuating means that facilitated the movement of the bladed end relative. Examples of actuating means include an motor with an off-set weight, wherein the motor may be electrically or hydraulically driven.

Preferably each of the tubular heating units are independently operable. In this way they can be operated at different stages of the downhole operation to suit the requirements of the job. With that said, the tubular heating units could also be operated in unison to deliver a concentrated burst of heat to the downhole target region.

Using multiple starters and starting methods (pressure, delay timer, temperature, radio communication, direct wired communication, etc.) will make it possible to accommodate larger alloy volumes, but it will also add more schedule flexibility for removing heating units from the melted alloy. This is particularly important as some plug and abandon regulations require the plug material to be homogeneous. In the worst case scenario, a heating unit might become stuck in frozen alloy requiring either a re-melt and/or fishing (retrieving) activities. One or more heating units might have a delayed start, burn longer than the other heating unit, or be saved for last in case a heater is frozen in the alloy plug.

Preferably the leading end of one or more of the tubular heating units is configured to make the unit topple when it sits on a substantially level platform. With regard to the leading end, this is considered to be the end of the heating unit that is deployed downhole first.

By way of an example, it is envisaged that the leading end of the heating unit may be slanted such that when it comes into contact with a platform in the downhole target region (e.g., a bridge plug or an existing alloy plug), the heating unit will be unable to stand up straight on its leading end and will topple away from the central axis of the heating tool. This facilitates the heating tool's transition from the deployment configuration to the heating configuration.

There are many ways the geometry of running and retrieving multiple heating units might be arranged. Flex lines or flexible lines could be used between heating units or heating units might all be run and retrieved in a bundle.

Preferably the tubular heating units are pivotably connected to a central carrier assembly aligned along the central axis of the heating tool. Further preferably the central carrier assembly is provided with one or more recesses, each of which is configured to at least partially receive one or more of said tubular heating units when the heating tool is in the deployment configuration.

In this way the heating tool can adopt a compact design when it is in the deployment configuration and then transition to the heating configuration by splaying the heating units radially outwards from the central carrier assembly on their pivots.

The carrier could be a machined part designed to make the effective running diameter smaller. The expanded position would be used to disperse the heat throughout the volume of the plug or seal.

Further preferably the heating tool may also comprise a retainer to control the extent to which the tubular heating units can pivot away from the central carrier assembly. It is envisaged that not only can the retainer be employed to limit the extent that the heating units extend away from the central carrier assembly, but it can also be used to control when the heating tool transitions from the deployment configuration to the heating configuration.

Preferably the transition of said pivotable heating units from the deployment configuration to the heating configuration may be facilitated by actuation means; wherein preferably the actuation means comprise resilient biasing means.

The heating units around the perimeter of the heating tool might be pinned, bolted, or hinged with flex line. This would allow them to deploy like an umbrella in either the right side up or upside-down orientation. Springs could be used to expand or retract the perimeter heaters. Pins, linkage bars, pneumatic, or hydraulic cylinders could be used to deploy, retract, limit travel, or retrieve heaters.

Preferably the central carrier assembly may itself be a heating unit. In this way the heating capacity of the heating tool can be further enhanced. If the central carrier is a heater, the OD could have machined grooves for clamps, brackets, and or linkages. It could even have milled pockets to allow the perimeter heaters to tuck in close to the central axis, making the smallest possible effective running diameter.

The quantity of heating units that can be nested in this fashion is limited by the cross section of the heaters, flex lines, heater geometry such as wall thickness, heater carrier dimensions (if a central carrier is used) and volume of alloy needed. If the heating units are to be left in the plug the flex lines may not be needed depending on the type of starter selected.

Preferably at least one of the tubular heating units is detachable from the heating tool. It is envisaged that in some downhole operations it may be more efficient to leave a heating unit in situ within the target region, and possibly even within the alloy, rather than to attempt retrieval of the heating tool in its entirety.

Although it is envisaged that the heating tools of the present invention may be used to melt alloy that has been delivered to the downhole target region separately (e.g. as alloy shot or beads), it is appreciated that is some operations it may be beneficial to deliver the alloy and the heating tool at the same time. Therefore, preferably at least one of the tubular heating units is provided with a eutectic and/or bismuth-based alloy on its outer surface.

Preferably said plurality of heating units comprise a range of tubular heating units having different configurations; wherein preferably the configuration characteristics of the tubular heating units include one or more of: a) the dimensions of the heating unit; b) the heat source of the heating unit; c) the starting mechanism of the heating unit; d) the construction of the heating unit; and e) the alloy provided on the outer surface of the heating unit.

For example, the potential heat energy density per unit of volume of the heating unit can be different within that heating unit and/or it can be different from one heating unit to another.

It is appreciated that the conveyance method used to run the downhole heating tool of the present invention in a well to the downhole target region can be Electric line, slick line, Drill Pipe, jointed tubing, or coiled tubing. With that said, it is also envisaged that the heating tool of the present invention may form part of a plugging and/or sealing tool.

According to another aspect of the present invention there is provided a downhole eutectic and/or bismuth alloy based plugging and/or sealing tool, said tool comprising: a downhole heating tool in accordance with present invention; a drilling tube with a ported sub located on the leading end of the drilling tube; and wherein the heating tool is secured to the ported sub such that the heating tool extends downhole of the drilling tube when the plugging and/or sealing tool is deployed downhole.

Further, the present invention also provides a method of heating a downhole target region, said method comprising: providing a heating tool comprising a plurality of discrete tubular heating units linked together by connection means that permit the movement of the tubular heating units relative to one another; deploying the heating tool to a downhole target region whilst maintaining the heating tool in a deployment configuration, in which the tubular heating units are arranged proximal to a central axis of the heating tool; upon arrival in the downhole target region, facilitating the transition of the heating tool to a heating configuration, in which at least one of the tubular heating units is displaced from the central axis to enable the heating tool to provide an expanded heating footprint within the downhole target region; and operating one or more of the tubular heating units to heat the downhole target region.

It will be appreciated that by employing the above method it is possible to deliver an increased amount of heat to a downhole target region, even in wellbore that have restricted access to the target region.

Preferably the method further comprises the step of providing a bridge plug below the target region prior to deployment of the heating tool. By deploying the bridge plug downhole before the heating tool is deployed, it is possible to create a platform on which the heating units can accumulate and splay out from the central axis of the heating tool to expand its heating footprint.

It is envisaged that the bridge plug is particularly effective when used in combination with a heating tool that has a plurality of heating units linked in series by flexible lines.

Further preferably the bridge plug may comprise an upper surface that is contoured to assist the displacement of the tubular heating units upon their arrival in the downhole target region. In will be appreciated that providing an uneven surface for the heating units will facilitate their splaying away from the central axis of the heating tool and therefore enhance the expansion of the heating footprint.

The present invention also provides a method of deploying a eutectic and/or bismuth alloy based plug and/or seal within a downhole target region, said method comprising: providing a bridge plug below the downhole target region; providing a heating tool comprising a plurality of discrete tubular heating units linked together by connection means that permit the movement of the tubular heating units relative to one another; deploying the heating tool to the downhole target region whilst maintaining the heating tool in a deployment configuration, in which the tubular heating units are arranged proximal to a central axis of the heating tool; upon arrival in the downhole target region, facilitating the transition of the heating tool to a heating configuration, in which at least one of the tubular heating units is displaced from the central axis to enable the heating tool to provide an expanded heating footprint within a downhole target region; providing a eutectic and/or bismuth based alloy in the target region; and operating one or more of the tubular heating units to heat the downhole target region and melt the alloy provided therein.

As noted above, preferably the alloy is delivered to the downhole target region in the form of alloy shot or alloy beads. This enables the alloy to be readily distributed around the heating units in the downhole target region.

Additionally or alternatively the alloy is preferably delivered to the downhole target region by the heating tool; wherein further preferably alloy is provided on the outside of one or more of the tubular heating units. This allows for the plugging/sealing operation to be carried out in a single deployment.

Very complex plugs and seals can be achieved utilizing this new technology of multiple heaters at the same well depth target. It is envisioned that multiple alloy compositions could be used to make a plug or seal. Utilizing this new technology opens a lot of new options for meltable alloy plugs and seals.

Preferably more than one type of eutectic and/or bismuth based alloy may be provided in the downhole target region; and further preferably each alloy type has a different density and/or melting point. It is envisaged that using a combination of alloys with different characteristics allows for the formation of multi-layer alloy plugs/seals within the downhole target region.

For example, each of the alloy compositions could use different materials that require different amounts of heat levels held for different periods of time. For example, a low melting point alloy might be used at the bottom of the target and might be constructed of some optimum plug height, say 4 to 60 inches. This might provide an insulative barrier which would allow higher melt temperature alloys to be used above.

Further, cost could be optimized by using less volume of more expensive alloy materials for intermediate plugs and seals or for the upper most plug or seal.

Preferably, in embodiments where more than one type of alloy is used, different tubular heating units may be used to melt each of the different alloy types provided in the downhole target region.

Preferably the method may further comprise the step of actuating one or more of the heating units to agitate the molten alloy within the target region; wherein further preferably the alloy is agitated by: a) rotating the heating unit(s) around their central axis; and/or b) raising and lowering the heating unit(s) up-hole and downhole; and/or c) vibrating the heating unit(s).

It is envisaged that agitating the alloy when it is molten not only helps with the transmission of heat through the alloy but it also reduces the amount of foreign material (i.e., non-alloy) that is trapped in the alloy plug or seal.

Preferably the heating tool may be retrieved from the downhole target region once the alloy has been melted. This ensures that alloy plug/seal formed in the downhole target region is homogenous.

With that said, it is envisaged that at least one of the tubular heating units may be detached from the heating tool and left in the downhole target region. Leaving one or more of the heating units in the target region may be operationally acceptable, especially in cases where a multi-layer alloy plug/seal is deployed. This is because the heating units may be embedded in one of the alloy layers, leaving the other layers as homogenous to satisfy well plugging regulations.

Different plug and seal designs are possible depending on well operator preference and well area regulations and codes. In some applications the heaters might be left in the plug or in lower levels of the plug or seal. The more stringent well plug and abandon codes and regulations require that the plug be homogeneous requiring that the heater(s) be removed.

Another example of running multiple heaters would be to run each and drop it off at the well depth target, drop the beads, melt the alloy, and make one or more trips to fish the individual heaters. They might be removed one at a time or two at a time if flex lines are used between heaters. Many variations are possible. Fish neck profiles could be machined in selected places. Slick line or electric line would be the best way to pull them utilizing shortest amount of trip time. If the target is shallow, coiled tubing, drill pipe or a jointed pipe work string might be viable options.

Another aspect of invention involves putting memory style, pressure and temperature gauges in or near the downhole heating tool. The gauges could be located in the ported sub (see FIG. 7) or in the central carrier of FIG. 8 or in a perimeter tube, replacing one of the heating units (see FIGS. 3, 4, 5, 6, and 8). In another configuration the pressure and temperature gauges might be located in a starter/running tool just above the heating units.

If using gauges measuring data while wired to the surface display computer, real time data could be gathered and used during the job. Data can be sent to the surface via electrical conductors or fibre optic cables. Smart drill pipe includes electrical conductors necessary to send data both up and down the line while in the well. Today, fibre optic cables are run on production tubing to gather data in a similar fashion.

BRIEF DESCRIPTION OF THE DRAWINGS

In order that the present disclosure may be more readily understood, preferable embodiments thereof will now be described, by way of example only, with reference to the accompanying drawings, in which.

DETAILED DESCRIPTION OF THE DISCLOSURE

The multi-heater arrangement of the downhole heating tool of the present invention facilitates the delivery of an increased heating effect to a downhole target region whilst at the same time ensuring that the heating tool does not become cumbersome or difficult to handle. As noted above, whilst the heating capacity of downhole tools can be increased by simply making a single heater bigger, this approach creates problems at least from the point of view of shipping, handling, manufacturing processes, heater wall materials, pressure holding capabilities, heat generating chemical volumes and other factors.

Although these issues apply to heating tools regardless of the heat sources they employ, the present invention is considered particularly effective for heating tools that employ chemical reaction heat sources (e.g., thermite and thermite based blends). In view of this the preferred embodiments described below relate to heating tools that employ chemical based heat sources. However, it is appreciated that alternative heat sources (e.g., electrical) could be employed instead to achieve similar technical benefits without departing from the general concept of the present invention.

Figure 1:
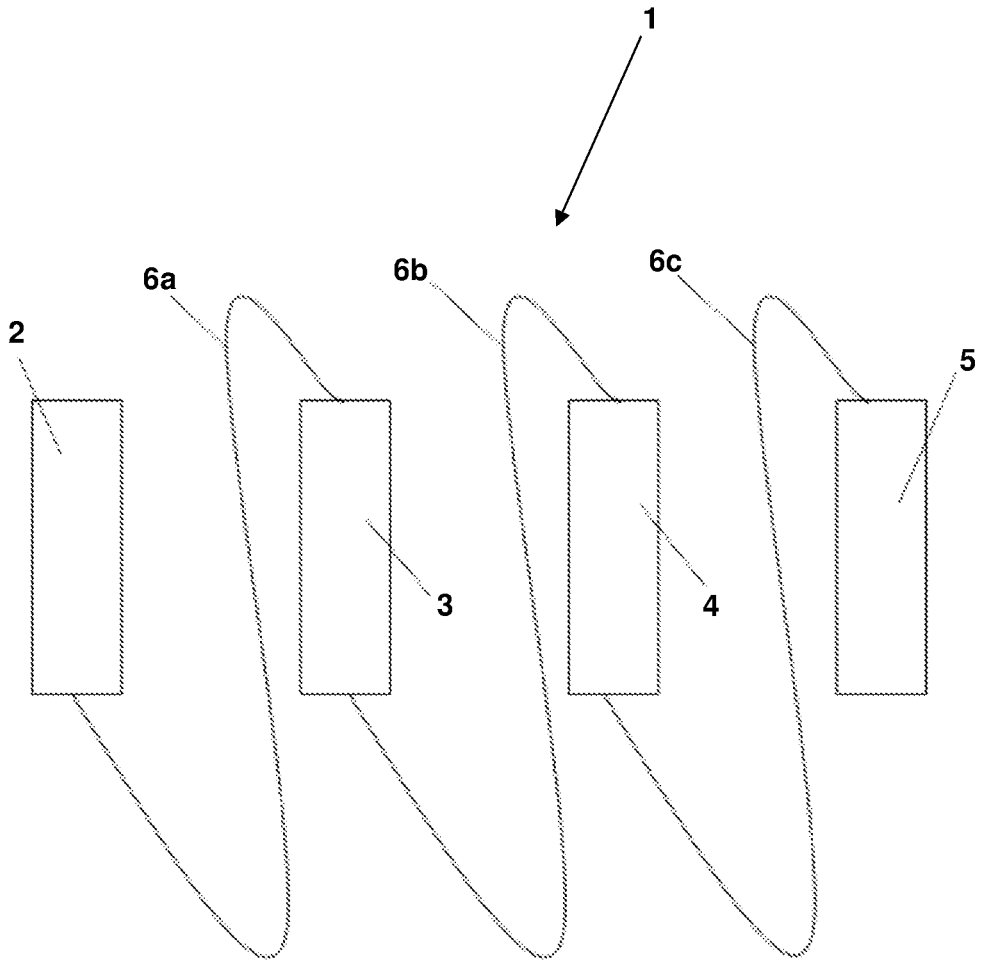
FIG. 1 shows a first preferred embodiment of a downhole heating tool according to the present invention.

A first preferred embodiment of the heating tool of the present invention will now be described with reference to FIGS. 1, 2 and 3. FIG. 1 shows a downhole heating tool 1 that is formed from four heating units 2, 3, 4, 5 with flex line 6*a*, 6*b*, 6*c*, between them. This sub assembly is made up prior to running in the well.

Each heating unit 2, 3, 4, 5 comprises a metal tubular main body containing a chemical heat source material, which may preferable be thermite or a thermite blend that includes other chemical agents (e.g., dampening agents, gas producing agents). It is appreciated that the heating units can employ any of the features that might be employed in existing stand-alone downhole heaters, numerous examples of which have been described in the applicant's earlier patents, as listed above.

The skilled person will appreciate that the tubular main bodies of the heating units can be made from a range of suitable metals, with steel one preferred material.

The end of adjacent heating units 2, 3, 4, 5 are linked together by flexible lines 6*a*, 6*b*, 6*c*. It is envisaged that flexible lines can take the form of high temperature synthetic rope; thin metal tube; chain, such as link chain or drive type chain; wire rope, including multi cross-section wire rope with electrical conductor(s); a sheath made of a plastic like material; or combinations thereof.

As will be appreciated from FIG. 1, the length of the flexible lines is such that the heating units can be brought into parallel alignment with one another.

Figure 2:
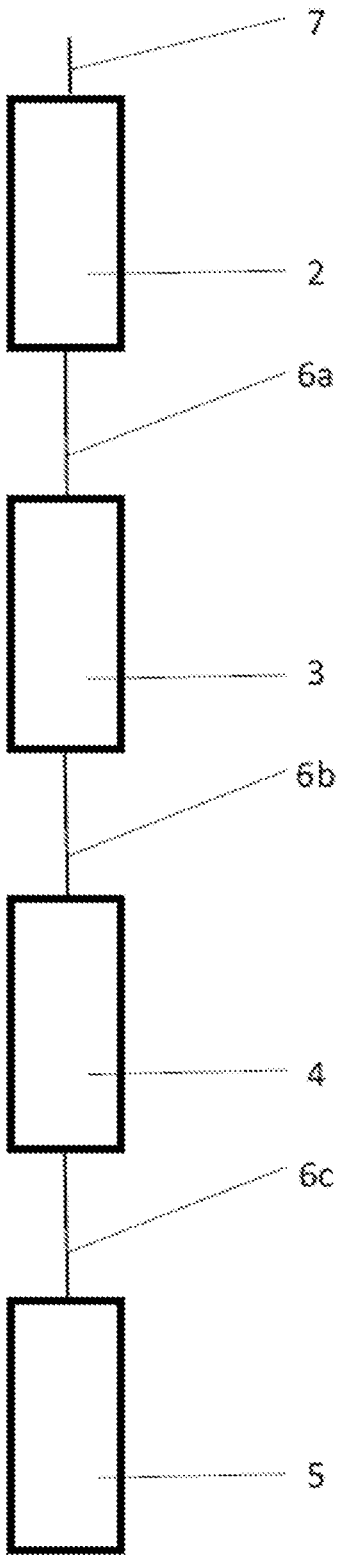
FIG. 2 shows the downhole heating tool of FIG. 1 in its deployment configuration.

At the same, as will be appreciated from FIG. 2, the flexible lines 6*a*, 6*b*, 6*c* enable the heating units 2, 3, 4, 5 to be suspended in a chain-like arrangement when the heating tool 1 is being delivered downhole to a target region. The flexible connections between the adjacent heating units enables the overall diameter of the heating tool to be limited during the deployment stage and then greatly increased once the heating tool has passed into the target region, which may have greater diameter than up-hole sections of the wellbore.

For the sake of clarity the flexible lines 6*a*, 6*b*, 6*c* are not shown as being longer that the heating units, however it will be appreciated that this is still a preferred arrangement of this variant of the heating tool of the present invention.

In order to deliver the heating tool 1 downhole, the upper most heating unit 2 is attached to a downhole delivery means 7, examples of which include electric line, slick line, drill pipe, jointed tubing, or coiled tubing. Further suitable downhole delivery means will become apparent to the skilled person upon consideration of the described invention. It is envisaged that a range of downhole delivery means can be employed without departing from the general scope of the present invention.

As noted above, FIG. 2 show the heating tool in a deployment configuration. This deployment configuration enables the heating tool 1 to be delivered downhole to a target region (i.e., where the heat is to be generated) even in situations where there is restricted access. For example, the tubing 11 may be 2⅞ inches in diameter whilst the casing 10 may be 13⅜ inches in diameter.

Figure 3:
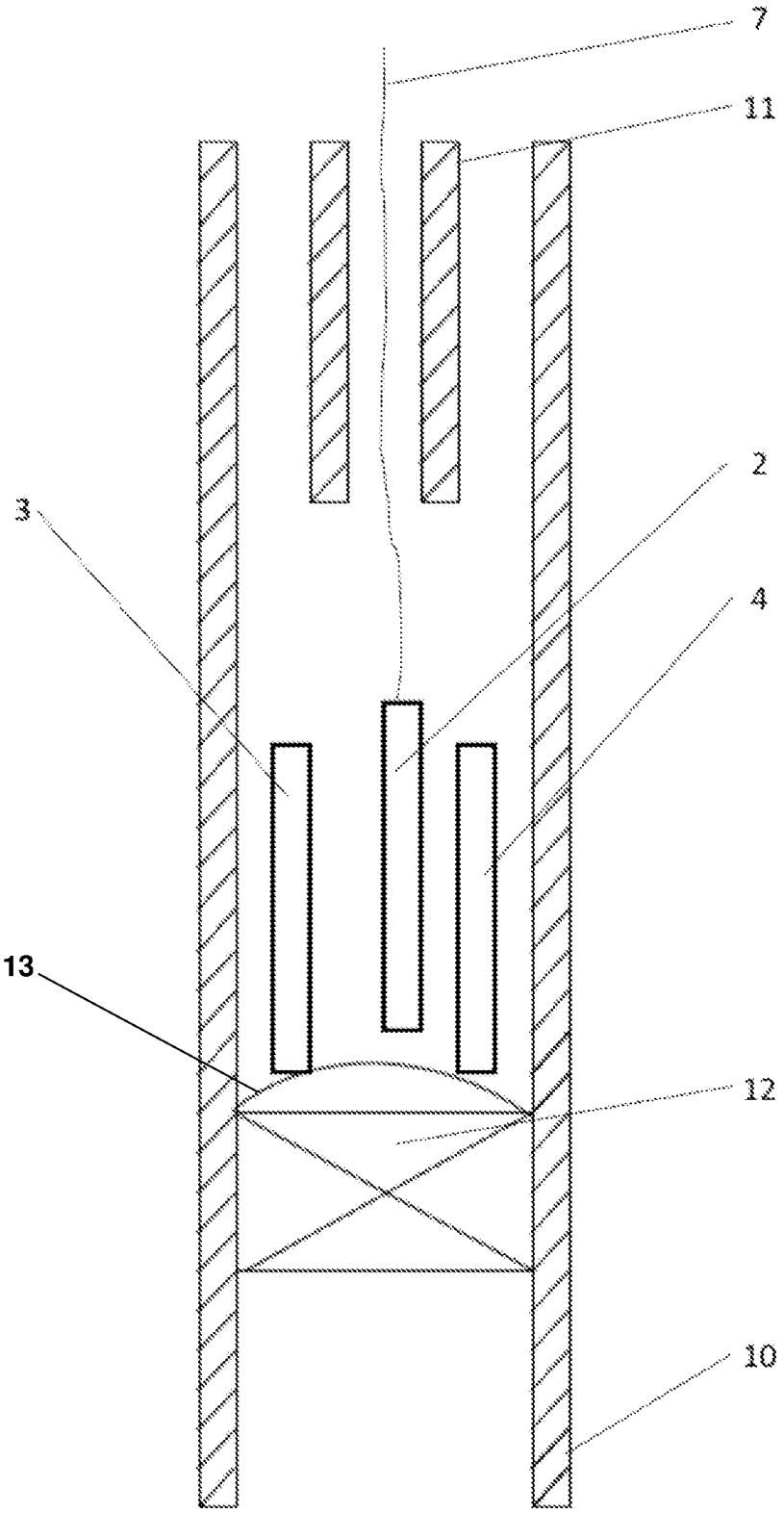
FIG. 3 shows the downhole heating tool of FIG. 1 in its heating configuration within a downhole target region.

Access to the downhole target region may be restricted by existing downhole tools or, as is the case in FIG. 3, existing well tubulars. As can be seen in FIG. 3, once the heating tool 1 has passed the restriction of the tubing 11 and arrives at the target region, it comes into contact with a platform. In the case of the situation shown in FIG. 3, the platform is provided by a bridge plug 12 that was deployed in the target region prior to the delivery of the heating tool 1.

As the deployment of bridge plugs is a relatively standard operation, it is not considered necessary to provide any further details of the operation here.

With that said however, it should be noted that it is considered preferable that the bridge plug 12 is configured to present a contoured upper surface 13. The contoured surface 13 may take the form of a dome, as shown in FIG. 3, or an alternate geometry such as slope or a trough. In the case of bowl shape or trough (concave with the low point near the centre of the vertical axis) the bottoms of the heating units would be forced toward the centre.

Providing the bridge plug with a contoured upper surface 13 helps to facilitate the heating tool's transition from the deployment configuration to the heating configuration by urging the heating units away from the central axis of the heating tool 1 (as effectively defined by the downhole delivery means 7).

The displacement of the heating units 2, 3, 4 (Nb. for the sake of clarity the flexible lines and heating unit 5 have been omitted) serves to expand the heating footprint of the heating tool within the target region.

Once the heating units 2, 3, 4, 5 are in position within the target region they can be initiated, either independently or as one, to start generating heat within the target region.

Although not shown in FIG. 3, it is envisaged that the heating tool 1 would be employed to melt alloy (i.e., eutectic and/or bismuth based alloy) within the target region in order to form an alloy plug therein. The alloy can be deployed downhole by the heating tool (e.g., mounted on the outside of one or more of the heating units) or it can be deployed downhole separately, preferably in the form of alloy beads or shot.

It is appreciated that the use of multiple heating units means that more alloy can be deployed downhole by the heating tool of the present invention, which allows large plugs to be set within target regions. With that said, in cases where the very large alloy plugs/seals are required, it is envisaged that alloy shot/beads deployed from the surface is the most effective way to deliver the necessary quantities of alloy to the target region.

The quality of the alloy plug/seal formed in the target region may be further enhanced by using alloy shot/beads that are coated with a flux material (e.g., flux borax). Flux coated beads or indeed flux added to metal sealing alloys may enhance the resulting seal integrity and or the conditioning of the surfaces the alloy will contact downhole. The benefits of employing flux in downhole environments are described in US 20060144591 A1.

Once the alloy has been melted within the target region the heating tool 1 can be retrieved by operating the downhole delivery means 7 in reverse. The retrieval of the heating tool 1 is preferably carried out while the alloy is still molten. With that said, it is envisaged that in some operations it may be preferable to only partially retrieve the heating tool, such that some, but not all, of the heating units are clear of the alloy.

This approach allows the lower most heating units to maintain the heating of the alloy whilst the upper heating units are extracted. This prevents all of the heating tool being frozen in place when the alloy cools and solidifies. This approach is made possible by configuring the lower most heating units to be detachable from the rest of the heating tool.

As noted above, leaving one or more of the heating units in the target region may be operationally acceptable, especially in cases where a multi-layer alloy plug/seal is deployed. This is because the heating units may be embedded in one of the alloy layers, leaving the other layers as homogenous to satisfy well plugging regulations.

Different plug and seal designs are possible depending on well operator preference and well area regulations and codes. In some applications the heaters might be left in the plug or in lower levels of the plug or seal. The more stringent well plug and abandon codes and regulations require that the plug be homogeneous requiring that the heater(s) be removed.

Figure 4:
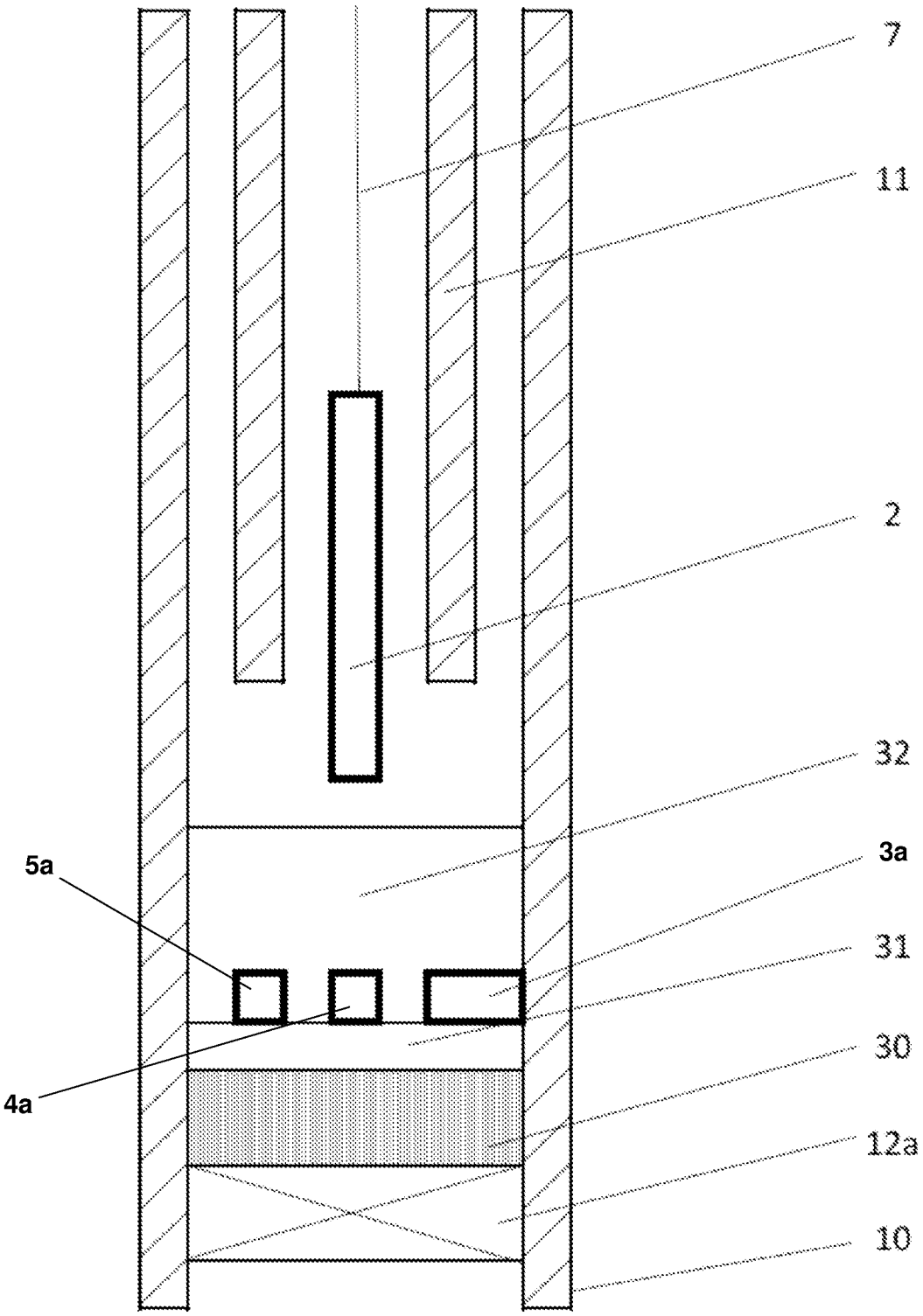
FIG. 4 shows a downhole target region in which a multi-layer alloy plug has been formed.

FIG. 4 shows a situation where some of the heating units 3*a*, 4*a*, 5*a* have been left in situ within an alloy when the rest of the heating units 2 of the heating tool are retrieved.

Although the heating units shown in FIGS. 1, 2 and 3 have essentially the same dimensions, it is appreciated that the heating tool of the present invention may comprise a plurality of heating units with different dimensions. For example, in situations where one or more heating units are to be left in the hole, such heating units 3*a*, 4*a*, 5*a*, may be smaller in size that the upper heater(s) 2 that are to be retrieved.

In FIG. 4 the alloy plug comprises multiple layers of different alloy compositions 30, 31, 32, which due to their different densities, separate out into layers when in their molten state.

It is envisaged that by selecting the alloy compositions such that some are more dense that the heating units and other alloy compositions are less dense, it is possible to control where the heating units sit in the molten alloy plug as it cools and solidifies. In this way it is possible to ensure the creation of at least one layer of a homogenous alloy in the multi-layer alloy plug.

The use of multi-layer downhole alloy plugs is described in more detail in the applicant's published International Application WO 2021/260442 A1.

With reference to the alloy layers of the multi-layer plug shown in FIG. 4 it is noted that bottom alloy layer 30, which is optional, is formed on top of bridge plug 12*a* as a spacer layer formed from a less expensive alloy. This can help reduce the material costs of the plugging operation.

As noted above, the middle alloy layer 31 is provided to locate the detachable heating units 3*a*, 4*a*, 5*a*. Finally, the upper most alloy layer 32, serves to provide the main barrier function of the alloy plug.

Figure 5:
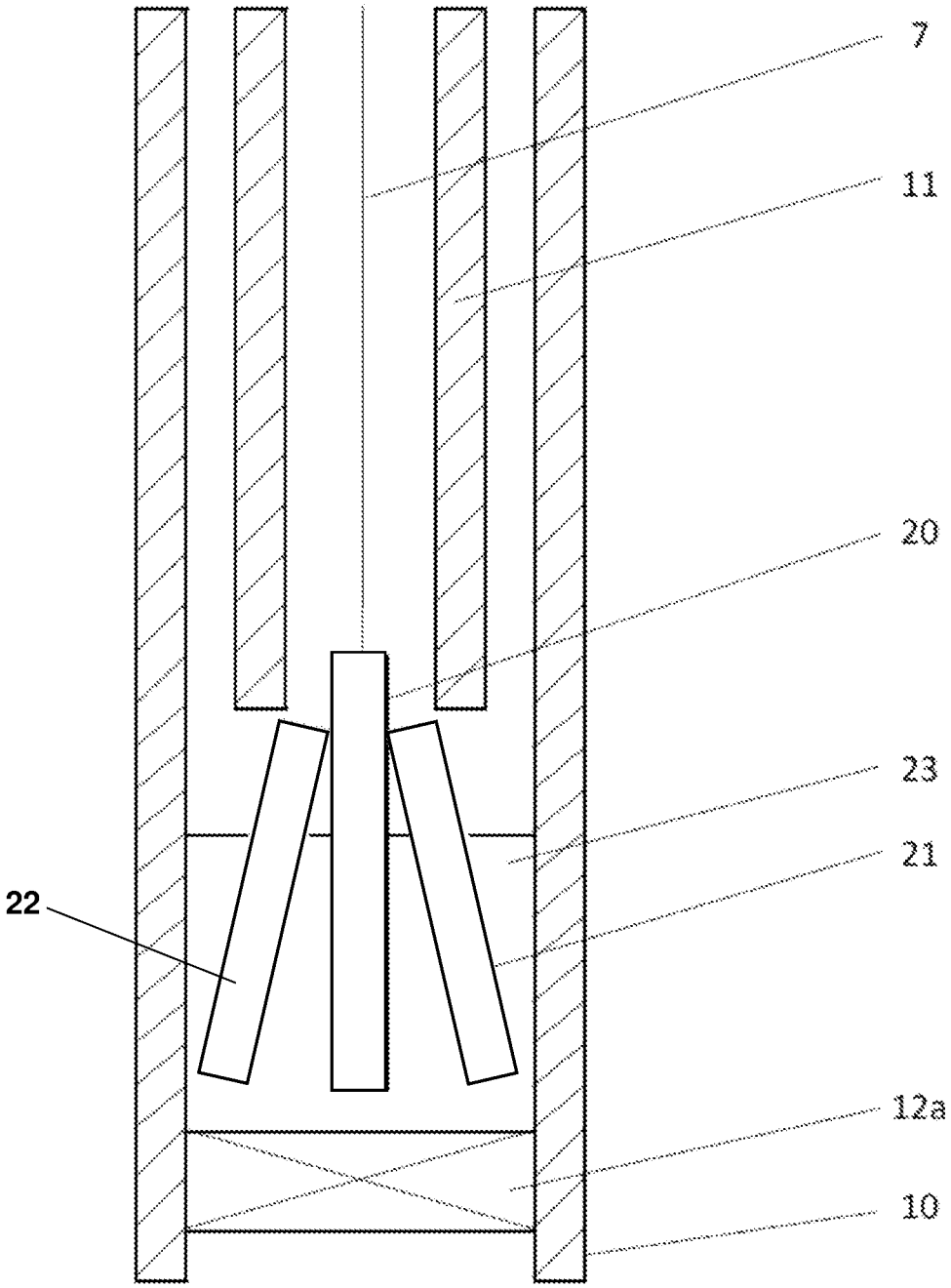
FIG. 5 shows a second preferred embodiment of a downhole heating tool according to the present invention in its heating configuration within a downhole target region.

FIG. 5 shows an alternative preferred embodiment of the heating tool of the present invention. The heating tool comprises a central carrier assembly 20 with a plurality of heating units 21, 22 pivotably mounted to it around its perimeter. Although only two perimeter heating units are shown in FIG. 5, it will be appreciated that the total number could be increased without departing from the general concept of the present invention.

In the example shown, the central carrier assembly 20 itself is also a heating unit. Again, it is envisaged that the heating units employed in this heating tool employ the same technical features of existing chemical heaters, albeit with the additional features required to enable them to be connected together to form the heating tool of the present invention.

The perimeter mounted heating units 21, 22 are configured to tuck in close to the central carrier assembly 20 to adopt a deployment configuration that has an outer diameter that is optimised for delivery downhole. The skilled person will appreciate that any suitable mechanisms may be employed to pivotably mount the heating units to the central carrier assembly at an up-hole region of the heating tool. Examples of which include: pins, brackets, linkages, welds, or combinations thereof.

The perimeter heating units 21, 22 are spring loaded so that when the units exit the restricted internal diameter (ID) of the tubing 11, they will move out away from the central vertical axis of the heating tool. This causes the heating tool to transition from the deployment configuration to the heating configuration where the heating units are displaced and the heating footprint on the heating tool is increased.

The heating units 20, 21, 22 can then be operated independently or in unison to heat the target region and any alloy 23 present therein. Once again, it is envisaged that alloy may be delivered downhole on the heating tool (i.e., on the outside of one of more heating units) or the alloy may be deployed to the target region separately (e.g., as alloy shot, or beads deployed from the surface).

Although not shown, it is envisaged that the central carrier assembly 20 may be provided with recessed regions that can at least partially accommodate the perimeter heating units 21, 22. In this way the outer diameter of the heating tool in its deployment configuration can be further optimised.

Figure 6:
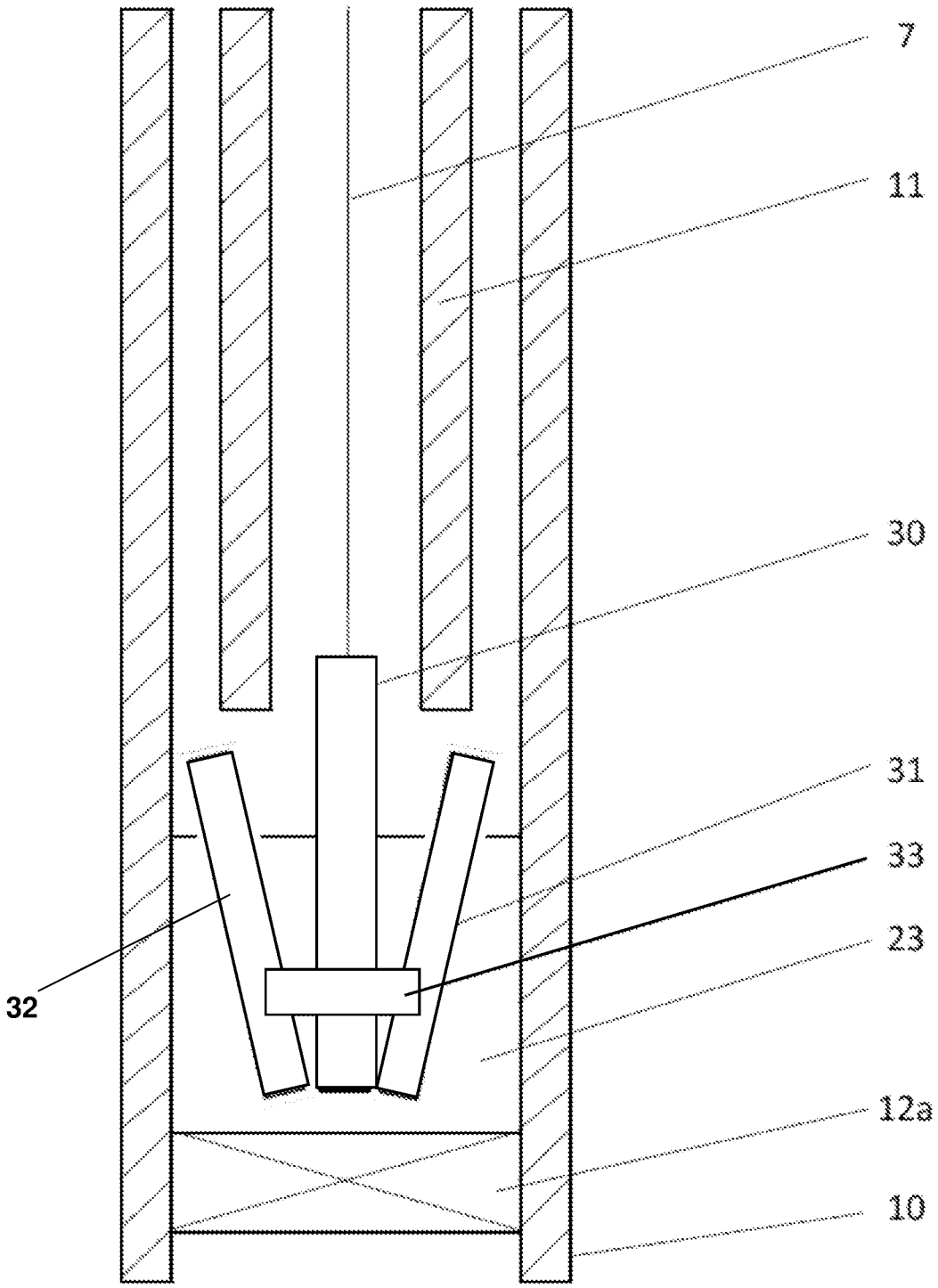
FIG. 6 shows a third preferred embodiment of a downhole heating tool according to the present invention in its heating configuration within a downhole target region.

FIG. 6 shows a variant of the preferred embodiment shown in FIG. 5. The heating tool shown in FIG. 6 is effectively an inverted, upside down arrangement of the heating tool shown in FIG. 5.

The heating tool shown in FIG. 6 comprises a central carrier assembly 30, which again is also a heating unit, with a plurality of heating units 31, 32 pivotally mounted to the perimeter of the assembly 30. In contrast to the heating tool shown in FIG. 5, the heating units are pivotally mounted to the central carrier assembly 30 at point toward the downhole end thereof.

This pivoting arrangement makes the perimeter heating units much more likely to splay outwards of their own accord under the action of gravity. In view of this, a retainer 33 is also provided to limit the radial movement of the perimeter heating units until it is time to transition the heating tool from the deployment configuration to the heating configuration.

The retainer 33 may be operated remotely, or on a timer, to effect the displacement of the perimeter heating units 31, 32 away from the central carrier assembly and the central axis of the heating tool. Although gravity alone may be sufficient to affect the transition of the heating tool from the deployment configuration to the heating configuration, it is envisaged that suitable actuators (not shown), such as resilient biasing means, might additionally be provided to ensure that the perimeter heating units are sufficiently displaced within the downhole target region.

Figure 7:
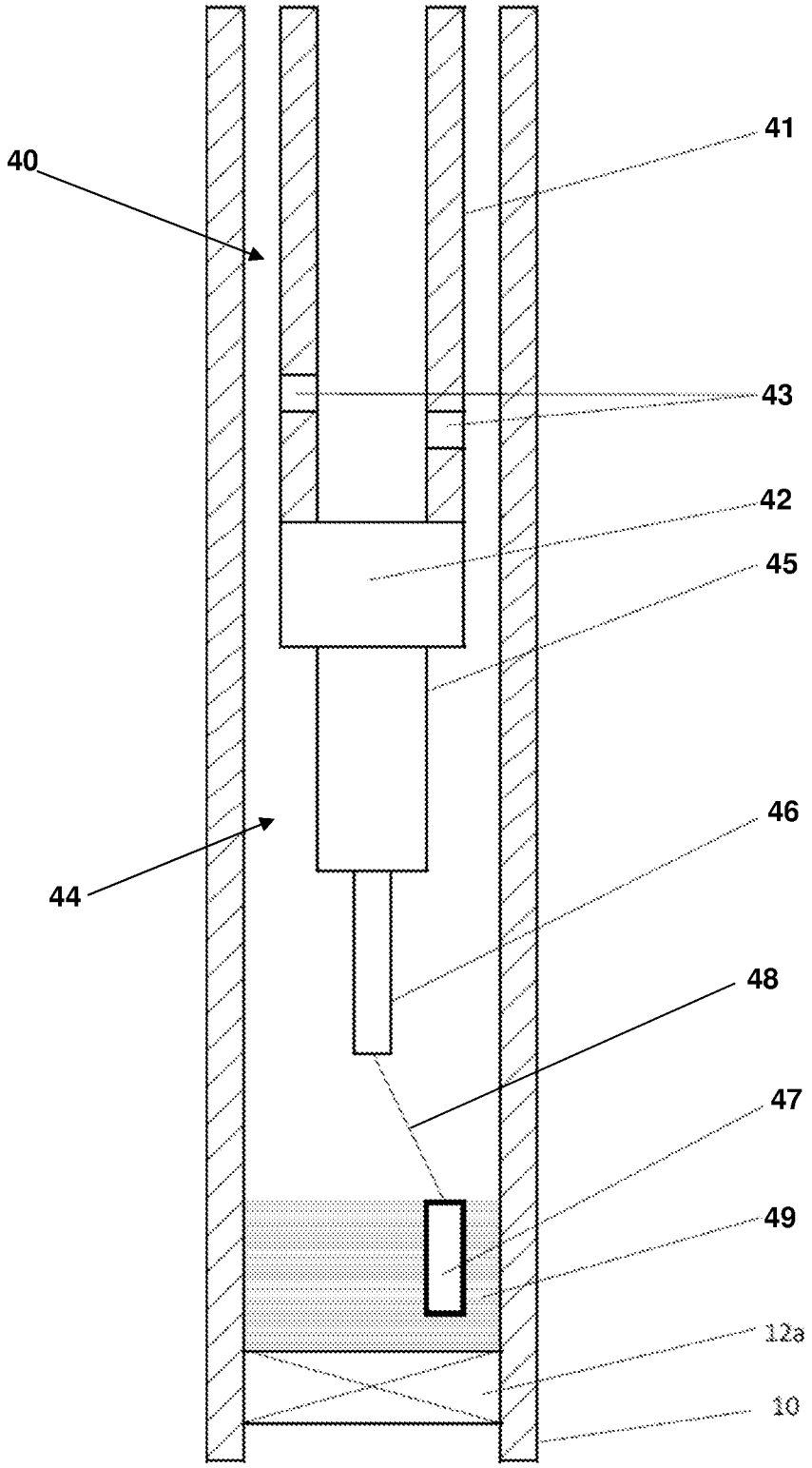
FIG. 7 shows a preferred embodiment of a downhole eutectic and/or bismuth alloy based plugging/and or sealing tool according to the present invention deployed downhole.

Some plugging operations are carried out in wellbore that do not have the restrictions of existing tubing. In such cases it is considered appropriate to deploy the downhole heating tool as part of a larger a downhole eutectic and/or bismuth alloy based plugging and/or sealing tool. FIG. 7 shows a preferred embodiment of one such tool 40.

The tool 40 comprises a drill pipe 41 with a ported sub 42 secured to its leading end, preferably by way of a threaded relationship. The ported sub 42 is provided with multiple ports 43 that allow fluid communication between the inside and the outside of the drill pipe 41.

A heating tool in accordance with the present invention is there secured to the end of the ported sub so that is extend down-hole of the drill pipe into a downhole target region. The heating tool shown 44 is a variant of the heating tool 1 shown in FIGS. 1, 2, and 3. However it is envisaged that other variants of the heating tool of the present invention, such as those shown in FIGS. 5 and 6, could also be used instead without departing from the general scope of the present invention.

The heating tool 44 comprises a pair of heating units 46 and 47 linked by a flexible line 48. The operation of the heating units may be monitored and controlled by starters and gauges provided in control section 45 of the heating tool.

Following the deployment of bridge plug 12*a*, the tool 40 can be deployed downhole with the heating tool 44 at the fore. For the sake of clarity, FIG. 7 does not actually show the heating tool 44 in its final heating configuration.

It will be appreciated that, as shown in the heating tool of FIG. 1, for example, multiple heating units would be provided. Also, it will be appreciated that in the final heating configuration the heating units would typically both be in the target region; although this is not essential, especially when multiple heating units are present.

Once in position, alloy beads/shot can be delivered downhole via the interior of the drill pipe 41, either passively (the beads are very heavy relative to the fluids in the pipe and will drop due to the gravitational force) or actively by pump. The alloy can then escape the drill pipe 41 via the ports 43 of the ported sub 42 and accumulate on top of the bridge plug 12*a*.

Once sufficient alloy has been deployed to the target region one or more of the heating tool's heating units 46, 48 can be initiated to start melting the alloy 49. Following the melting of the alloy 49, the heating tool 44 can be retrieved from the wellbore along with the rest of the tool 41.

Figure 8:
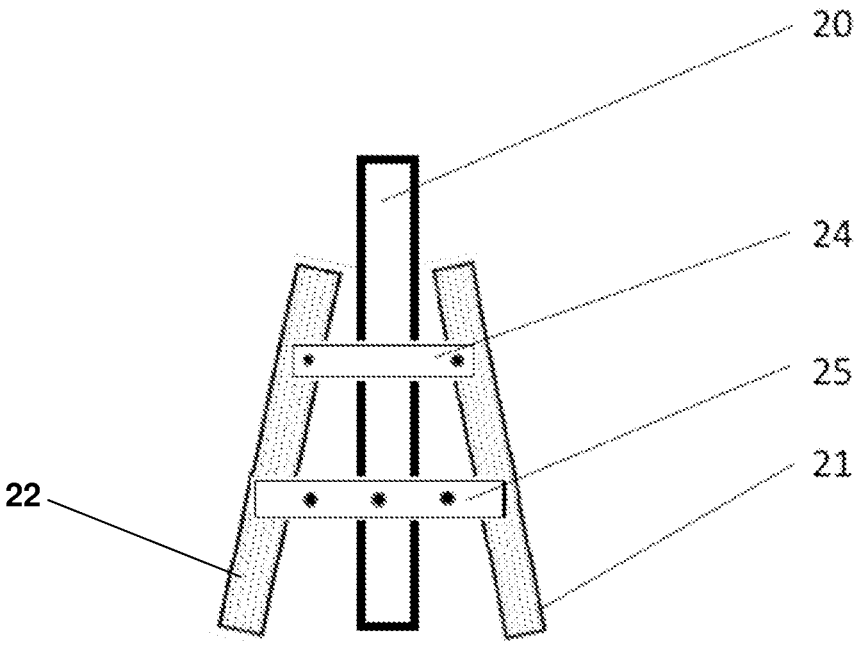
FIG. 8 shows a more detailed view of the downhole heating tool of FIG. 5.
Figure 9:
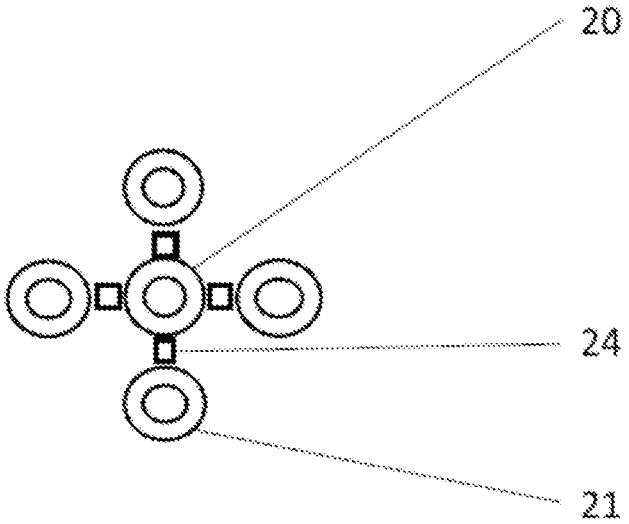
FIG. 9 shows a plan view of the downhole heating tool of FIG. 8.
Figure 10:
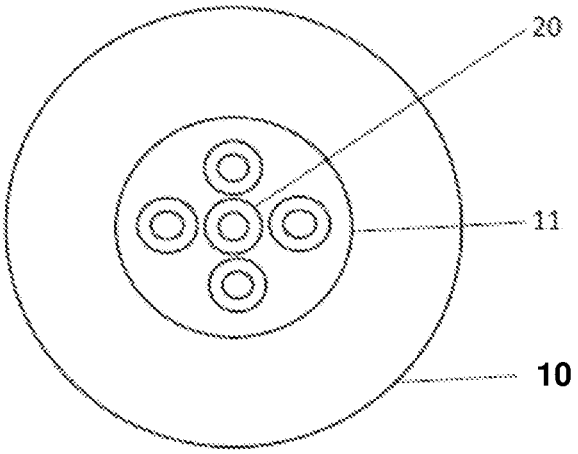
FIG. 10 shows a plan view of the downhole heating tool of FIG. 8 being deployed downhole.

FIGS. 8, 9 and 10 show further views of the heating tool of FIG. 5. FIG. 8 shows the perimeter heating units 21, 22 connected to the central carrier assembly (which is also a heating unit) 30 by a bracket means 24 that are configured to facilitate the pivoting of the perimeter heating units 21, 22 relative to the central carrier assembly 30 and the central axis of the heating tool.

In addition, a retainer 25 is provided to control the extent to which the heating units 21, 22 can splay outwards away from the central carrier assembly 30. Although not shown, it is envisaged that the retainer 25 may further comprise actuation means to control the transition of the heating units from the deployment configuration to the heating configuration. For the sake of clarity only two perimeter heating units are shown. However it is envisaged that the number of perimeter heating units may range from 1 to 2800.

Typically the perimeter heating units, and indeed all of the heating units employed in the heating tool of the present invention, would have diameter of between 0.25 and 13⅜ inches. It is envisaged that it situations where the central carrier assembly is also a heating unit, the perimeter heating units will typically be of a smaller diameter than the central heating unit.

However, with that said, it is envisaged that in some embodiments of the present invention, the central heating unit may actually be smaller than the perimeter heating units.

Once again, as noted above, it is envisaged that one or more of the heating units may be provided with alloy cast around its outer surface.

FIG. 9 shows a variant of the heating tool shown in FIGS. 5 and 8, albeit in plan view so that the arrangement of the perimeter heating units around the central carrier assembly 20 can be appreciated. The bracket means 24 that act as the linkage between the heating units and the central carrier assembly are also shown.

FIG. 10 shows, in plan, the heating tool of FIG. 9 being deployed downhole via an inner tubing 11 located within an outer casing 10.

When used in this specification and claims, the terms "comprises" and "comprising" and variations thereof mean that the specified features, steps or integers are included. The terms are not to be interpreted to exclude the presence of other features, steps or components.

Figure 11:
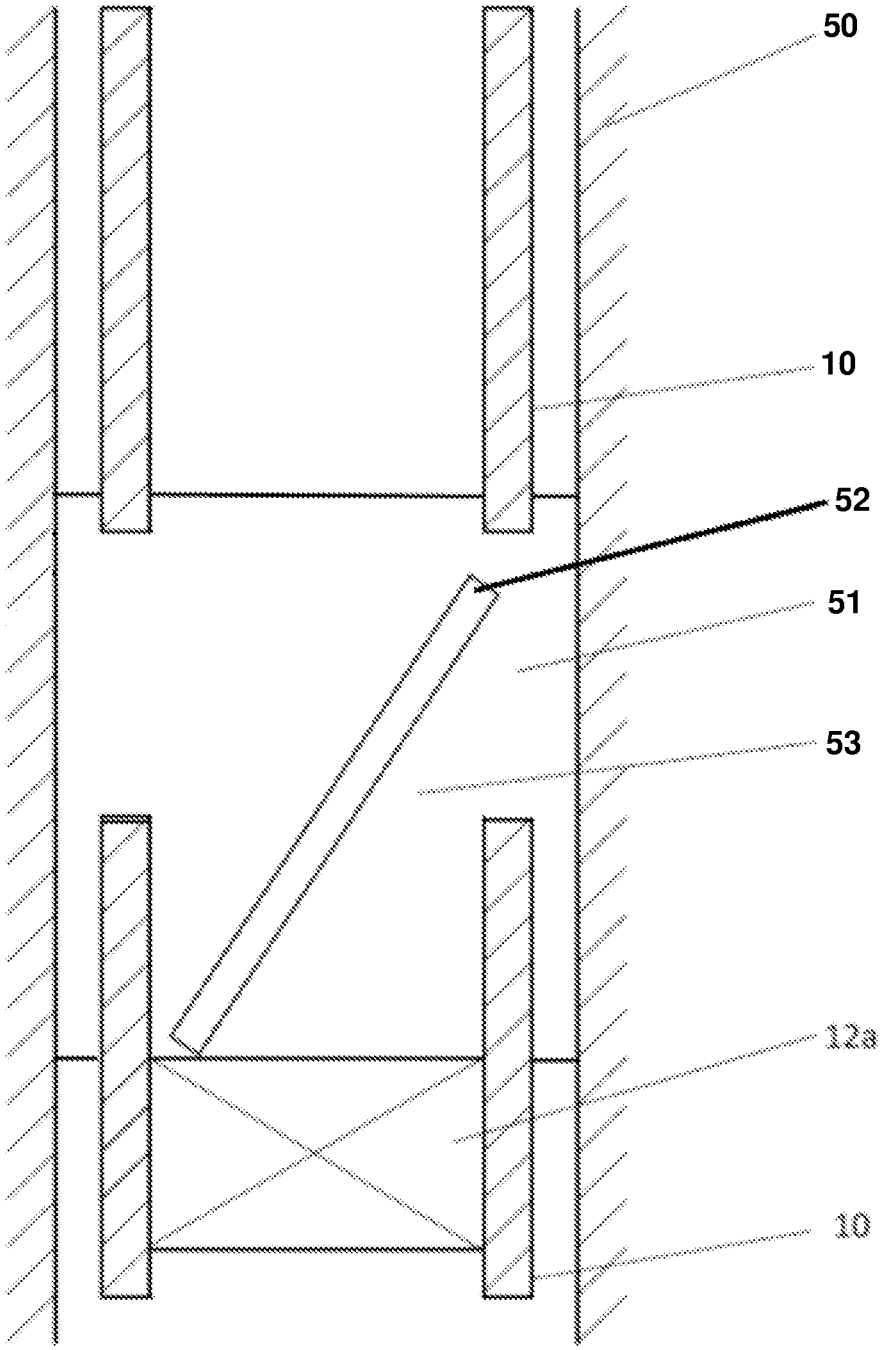
FIG. 11 shows a downhole heating tool according to a further aspect of the present invention in a milled out target region.

FIG. 11 shows downhole target region in which a portion of the well casing 10 has been removed, preferably by milling, in order to directly expose the surrounding formation 50. It will be appreciated that in the area 51 where the casing 10 has been removed the effective outer diameter to be sealed is increased.

It is envisaged that in such situations the downhole heating tool may comprise at least one heating unit 52 that is slimmer and longer than conventional heaters, with elongate heating tools of between 20 to 200 feet considered preferable.

By providing at least one heater that is slimmer and of extended length it is envisaged that the heating unit 52 can rest on the platform of the bridge plug 12*a* and then, due to the relative freedom of movement between it and the other heating units in the heating tool (not shown), tilt into the space 51 created by the removal of the casing 10.

If a flexible line with electrical communication is not used, the heating units may be run into place with pipe or electric line and a disconnect tool might be used to place the heating units in downhole target region on top of the bridge plug 12*a*.

By extending an end of the heating unit 51 beyond the casing 10 into the annular space between the casing 10 and the formation 50, the heating footprint of the heating tool is extended. This facilitates the melting of alloy 53 to enable to formation of an alloy seal/plug that extends across the entire cross-section of the milled out portion of target region.

Although only one heating unit is shown in FIG. 11, it will be appreciated that the heating tool contains more than one heating unit and that, preferably, more than one of the additional heating units has a longer length. In this way heating units can be arranged so as to extend radially outwards in more than one direction into the milled out area 51 of the target region.

A chemical starter assembly will be included in the heating unit 51. The heater can be started with pressure, time delay, or any other means.

As with the other preferred embodiments of the heating tools, it is envisaged that the elongated heating unit 52 may or may not be detachable from the rest of the heating tool.

Figure 12:
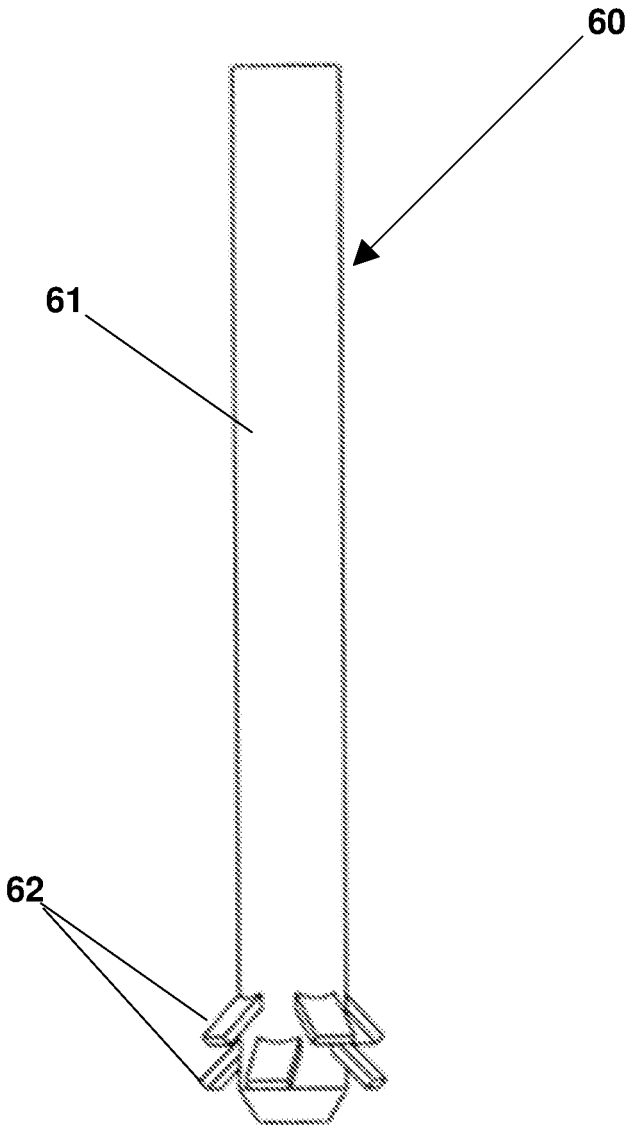
FIG. 12 shows a preferred embodiment of a heating unit with an agitating function that can be used in the downhole heating tool of the present invention.

FIG. 12 shows a preferred embodiment of a heating tool according to a further aspect of the present invention. The heating unit 60, which it is appreciated may be used as part of a larger heating tool in accordance with the present invention, comprises a main tubular heating body 61 with a plurality of blades 62 arranged around the leading end of the heating unit. The leading end is the end of the tubular heating body that will be deployed downhole first and/or the end of the heating unit that sits lowest in the wellbore once the heating tool has been delivered to the downhole target region.

The blades 62, may be welded, riveted, brazed, glued, bolted, or secured to the outside of the main tubular heating body 61 in some other fashion.

It is envisaged that the blades 62 enable the heating unit 60 to be used to 'stir' molten alloy during the operation of the heating unit. It is considered advantageous to agitate the molten alloy because it only promotes the passage of heat through the alloy but it also reduces the amount of foreign material (i.e., non-alloy) that is trapped in the alloy plug or seal. As noted above, it important that alloy plugs are homogenous to meet regulatory requirements.

The heating unit 60 can be operated in a number of ways so as to agitate the alloy in the target region with the blades 62. For example, the heating tool 60 could be rotated about its central axis. In the case of the plugging/sealing tool shown in FIG. 7, it is noted that rotating the drill pipe would enable the upper heating tool to rotate. As such, it will be appreciated that the bladed heating tool could be used in combination with the plugging/sealing tool shown in FIG. 7.

It is considered possible that even without the outer blades, rotating a heating tool within the alloy may affect a certain amount of agitation to the alloy. However, the provision of blade (or other suitably shaped projections) on the outer surface of the heating tool delivers a beneficial agitating effect.

Alternatively to the rotation of the heater, or indeed additionally, the heating tool 60 could be moved up and down within the target region to agitated alloy.

Yet another approach is to vibrate the heating tool; again this can be done in combination with the other movements or on its own. The vibration of the heating tool may be effected by providing a motor with an off-set weight within the a main tubular heating body 61.

It is envisaged that a hydraulic or electric motor can be used to spin a propeller or an offset weight causing vibrations which can be translated to the molten alloy.

As a further option for agitating the alloy in the downhole target region during the operation of the heating tool of the present invention, it to use an acoustic device to generate ultrasonic waves or pressure waves through the molten alloy before it has solidified.

As high frequency sound waves are transmitted through the molten alloy they produce microscopic cavitation bubbles when they come in contact with the casing or the heater. As these microscopic bubbles form and collapse they release huge amount of energy which can be utilized to clean or agitate the Alloy-Casing sealing interface.

Transducers can be placed below the heating tool to generate waves in an upward direction or in the molten alloy section itself to generate waves radially outwards. The transducer assembly could be mounted below the heating tool and once the heating units are done burning and melting the alloy the heating tool can be retrieved from the molten alloy bringing the transducer assembly up and placing it directly inside the molten alloy where it can be activated to generate ultrasonic waves.

A yet further option for agitating the molten alloy in downhole target region is to use a base of Liquid Thermite or gas generating material which can be activated once the alloy is molten to generate a steady stream of bubbles for a short duration of time (akin to that in a fizzy drink bottle).

As the stream of bubbles are generated they will rise through the molten alloy agitating and moving around the molten alloy before it can solidify.

The invention may also broadly consist in the parts, elements, steps, examples and/or features referred to or indicated in the specification individually or collectively in any and all combinations of two or more said parts, elements, steps, examples and/or features. In particular, one or more features in any of the embodiments described herein may be combined with one or more features from any other embodiment(s) described herein.

Protection may be sought for any features disclosed in any one or more published documents referenced herein in combination with the present disclosure.

Although certain example embodiments of the invention have been described, the scope of the appended claims is not intended to be limited solely to these embodiments. The claims are to be construed literally, purposively, and/or to encompass equivalents.

The invention claimed is:

1. A downhole heating tool comprising a plurality of discrete tubular chemical heater, wherein adjacent tubular chemical heaters are linked together by flexible lines that permit the movement of the tubular chemical heaters relative to one another; said flexible lines being longer than said tubular chemical heaters; and wherein the one or more flexible lines facilitate a transition of the heating tool between a deployment configuration, in which the tubular chemical heaters are arranged proximal to a central axis of the heating tool to optimise the geometry of the heating tool during its deployment downhole, and a heating configuration, in which at least one of the tubular chemical heaters is displaced from the central axis to enable the heating tool to provide an expanded heating footprint within a downhole target region by arranging adjacent linked tubular chemical heaters side by side with one another within the downhole chemical region.

2. The downhole heating tool of claim 1 wherein each of said flexible lines is selected from a group consisting of: synthetic rope; metal tube; chain, and wire rope, including multi cross-section wire rope with electrical conductor(s); a sheath made of an elastomeric or non-elastomeric material; or combinations thereof.

3. The downhole heating tool of claim 1 wherein at least one of the chemical heaters is between 20 and 200 feet long.

4. The downhole heating tool of claim 1 wherein at least one of the chemical heaters comprises one or more bladed projections extending from a downhole end thereof.

5. The downhole heating tool of claim 1 wherein at least one of the tubular chemical heaters is detachable from the heating tool.

6. The downhole heating tool of claim 1 wherein at least one of the tubular chemical heaters is provided with a eutectic and/or bismuth-based alloy on its outer surface.

7. The downhole heating tool of claim 1 wherein said plurality of chemical heaters comprise a range of tubular heating units having different configuration characteristics, wherein the configuration characteristics of the tubular chemical heaters include one or more of:

a) the dimensions of a chemical heater;
b) the composition of a chemical heat source of a chemical heater;
c) the starting mechanism of a chemical heater;
d) the construction of a chemical heater; and
e) the alloy provided on the outer surface of a chemical heater.

8. The downhole heating tool of claim 1 wherein a leading end of one or more of the tubular chemical heaters is configured to make the heater topple when positioned on a substantially level surface.

9. A downhole eutectic and/or bismuth alloy based plugging and/or sealing tool, said tool comprising:

a downhole heating tool in accordance with any one of the preceding claims;
a drilling tube with a ported sub located on the leading end of the drilling tube; and
wherein the heating tool is secured to the ported sub such that the heating tool extends downhole of the drilling tube when the plugging and/or sealing tool is deployed downhole.

10. A method of heating a downhole target region, said method comprising:

providing a heating tool comprising a plurality of discrete tubular chemical heaters linked together by one or more flexible lines that permit the movement of the tubular chemical heaters relative to one another wherein adjacent chemical heaters are capable of side-by-side arrangement;

deploying the heating tool to a downhole target region whilst maintaining the heating tool in a deployment configuration, in which the tubular chemical heaters are arranged proximal to a central axis of the heating tool;

transitioning of the heating tool to a heating configuration, in which at least one of the tubular chemical heaters is displaced from the central axis and arranged side-by-side within the downhole target region to enable the heating tool to provide an expanded heating footprint within the downhole target region; and operating one or more of the tubular chemical heaters to heat the downhole target region.

11. The downhole heating method of claim 10, wherein the method further comprises the step of providing a bridge plug below the target region prior to deployment of the heating tool; wherein the bridge plug comprises an upper surface that is contoured to assist the displacement of the tubular chemical heaters upon their arrival in the downhole target region.

12. The downhole heating method of claim 10 wherein a leading end of one or more of the tubular chemical heaters is configured to make the heater topple when positioned on a substantially level surface.

* * * * *